US010176780B2

(12) United States Patent
Wang et al.

(10) Patent No.: US 10,176,780 B2
(45) Date of Patent: Jan. 8, 2019

(54) POWER FOR AN HDMI SOURCE DEVICE

(75) Inventors: Yeqing Wang, Horsham, PA (US); Brian M. Carroll, Quakertown, PA (US)

(73) Assignee: ARRIS Enterprises LLC, Suwanee, GA (US)

( * ) Notice: Subject to any disclaimer, the term of this patent is extended or adjusted under 35 U.S.C. 154(b) by 0 days.

(21) Appl. No.: 13/572,066

(22) Filed: Aug. 10, 2012

(65) Prior Publication Data

US 2014/0043539 A1 Feb. 13, 2014

(51) Int. Cl.
*G06F 3/00* (2006.01)
*G09G 5/00* (2006.01)

(52) U.S. Cl.
CPC ..... *G09G 5/006* (2013.01); *G09G 2370/12* (2013.01); *G09G 2370/22* (2013.01)

(58) Field of Classification Search
None
See application file for complete search history.

(56) References Cited

U.S. PATENT DOCUMENTS

| | | | | |
|---|---|---|---|---|
| 6,800,962 | B2 | 10/2004 | Bahl et al. | |
| 2008/0186078 | A1* | 8/2008 | Shintani et al. | 327/365 |
| 2009/0083825 | A1* | 3/2009 | Miller et al. | 725/151 |
| 2011/0283129 | A1 | 11/2011 | Guillerm | |

FOREIGN PATENT DOCUMENTS

| | | | |
|---|---|---|---|
| EP | 2362643 | A1 | 8/2011 |
| WO | 2009/032333 | A1 | 3/2009 |

OTHER PUBLICATIONS

Boost Converter, Jan. 27, 2009, Wikipedia.com, pp. 1-5.*
PCT Search Report & Written Opinion, Re: Application # PCT/US2013/053964, dated Oct. 9, 2013.
Official Action, Re: Korean Application No. 10-2015-7004835 (Foreign Text and English Translation) dated Dec. 10, 2015.
Official Action, RE: Korean Application No. 10-2015-7004835, dated Apr. 27, 2016.
Official Action, RE: Korean Application No. 10-2015-7004835, dated Jun. 7, 2016.
Official Action, Re: Canadian Application No. 2,881,352, dated Jun. 9, 2016.
Official Action, Re: Korean Application No. 10-2016-7018485, dated Apr. 20, 2017.

(Continued)

*Primary Examiner* — Henry Tsai
*Assistant Examiner* — Dean Phan
(74) *Attorney, Agent, or Firm* — Stewart M. Wiener

(57) ABSTRACT

A device is provided for use with an audiovisual device and a cable having a first end and a second end. The audiovisual device can receive digital television audiovisual signals. The cable includes a data channel, a control channel and a power line and can transmit the digital television audiovisual signals. The first end can connect to the audiovisual device, whereas the second end can connect to the device. The device includes a connector, a detecting portion and a power source. The connector can connect to the second end. The detecting portion can generate a connection signal based on a connection of the connector to the second end. The power source can provide power based on the connection signal.

13 Claims, 9 Drawing Sheets

(56) References Cited

OTHER PUBLICATIONS

Official Action, Re: Canadian Application No. 2,881,352, dated May 11, 2017.
Official Action, Re: Korean Application No. 10-2016-7018485, dated Aug. 30, 2016.
Official Action, RE: Korean Divisional Application No. 10-2016-7018485, dated Nov. 13, 2017.
Official Action, RE: Korean Divisional Application No. 10-2016-7018485, dated Jan. 19, 2018.

* cited by examiner

POWER FOR AN HDMI SOURCE DEVICE

CROSS-REFERENCE TO RELATED APPLICATION

Related subject matter is disclosed in the following patent application, which is commonly owned and co-pending with the present application, and the entire contents of which are hereby incorporated by reference: U.S. application Ser. No. 13/572,057, filed on even date herewith, entitled "TWO-WAY HDMI COMMUNICATION".

BACKGROUND

Embodiments relate to a method of limiting the power consumption on an HDMI source device by detecting the connection of a HDMI sink device through a high definition multimedia interface (HDMI) cable. HDMI is a digital interface that is capable of carrying high-definitional video and digital audio channels all in one cable. HDMI delivers high quality audio and video without the risk of quality loss due to the conversion or compression of a video or audio signal.

BRIEF SUMMARY OF THE DRAWINGS

The accompanying drawings, which are incorporated in and form a part of the specification, illustrate example embodiments and, together with the description, serve to explain the principles thereof. In the drawings.

DETAILED DESCRIPTION

Figure 1:
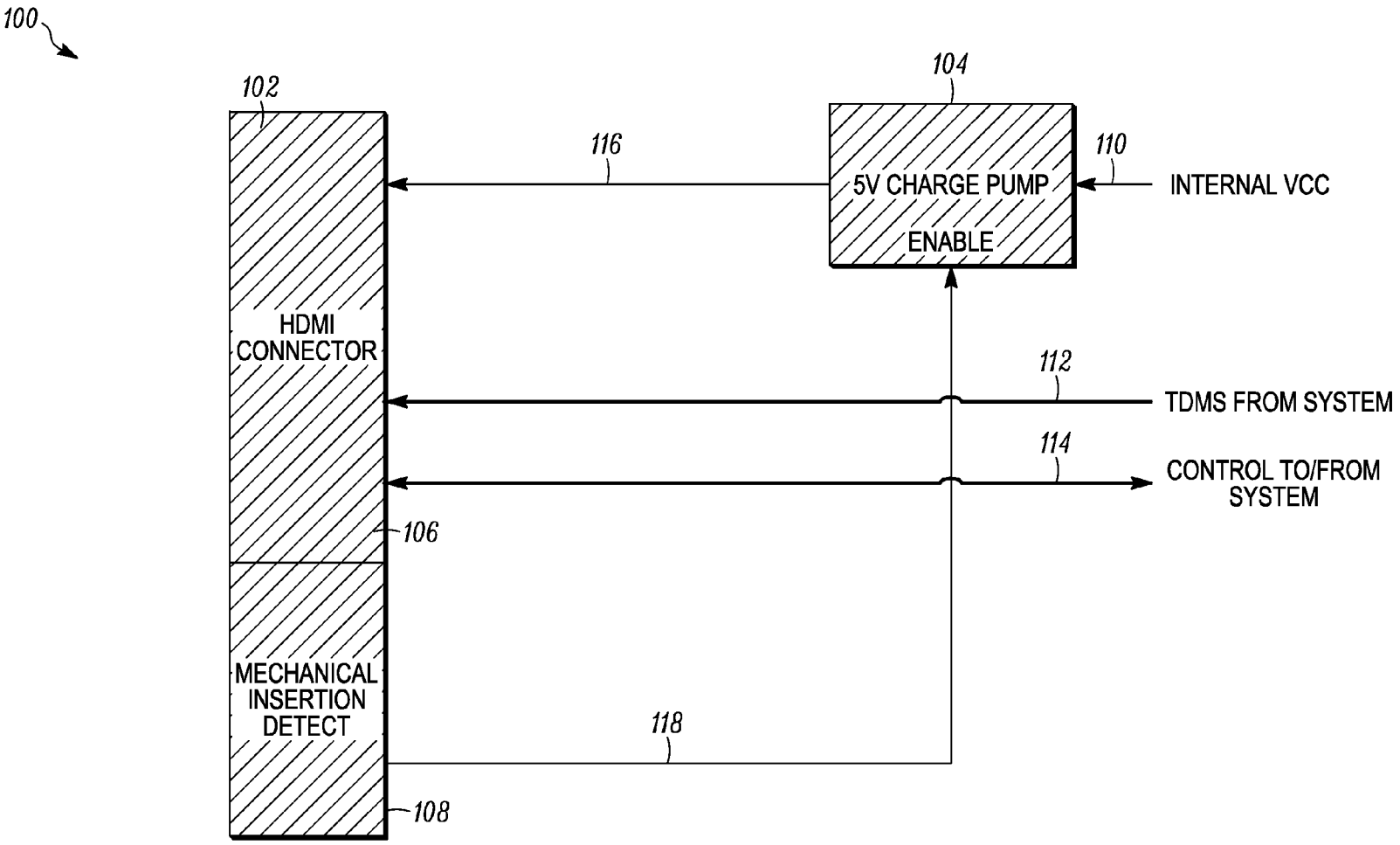
FIG. 1 illustrates an example HDMI connection.

In HDMI-compliant devices, the device that transmits content (source) must provide a constant 5V on the interface link for connection detection and other purpose. If the device providing the content is connected to an external power source such as a wall socket, providing a constant 5V is easily achievable.

A problem with having to provide a constant 5V to the interface connection occurs if the device providing the content (source) has a limited amount of power, such as a cell phone or other mobile devices. In these cases providing a constant 5V is much more difficult and additionally depletes power resources much faster.

Aspects of the present invention provide a method and mechanism for detecting the connection of devices with an HDMI cable such that the transmitting device can dynamically provide the 5V output when required and not be burdened with supplying and/or generating the 5V when a device is not connected.

Non-limiting embodiments provide a system and method for detecting the insertion of an HDMI connector, either mechanically or electrically. Non-limiting embodiments additionally provide for enabling a charge pump after the detection of an HDMI connector insertion.

In accordance with embodiments, a device is provided that is operable to mechanically detect the insertion of an HDMI cable. The insertion of an HDMI cable is detected by a pressure switch, once an insertion is detected by the pressure switch a charge pump is enabled to transform the voltage that is provided by the transmitter of content into a constant 5V signal that is then transmitted along with content to a receiver of content via an HDMI cable.

In accordance with embodiments, a device is provided for use with an audiovisual device and a cable having a first end and a second end. The audiovisual device can receive digital television audiovisual signals. The cable includes a data channel, a control channel and a power line and can transmit the digital television audiovisual signals. The first end can connect to the audiovisual device, whereas the second end can connect to the device. The device includes a connector, a detecting portion and a power source. The connector can connect to the second end. The detecting portion can generate a connection signal based on a connection of the connector to the second end. The power source can provide power based on the connection signal.

Additional advantages and novel features of embodiments are set forth in part in the description which follows, and in part will become apparent to those skilled in the art upon examination of the following or may be learned by practice of embodiments. The advantages of embodiments may be realized and attained by means of the instrumentalities and combinations particularly pointed out in the appended claims.

Embodiments employ a system and method for detecting the insertion of an HDMI cable into a device and the enabling of a voltage generating device once an insertion has been detected. In one embodiment, a pressure switch is used to detect the insertion of an HDMI cable. When an HDMI connector is inserted into a device, the connector depresses a pressure sensitive switch. When the switch is activated it signals that an HDMI cable has been connected and that a charge pump should be enabled.

In another embodiment, an HDMI cable insertion may be detected using an electrical circuit. Transmitting power or a content signal over an HDMI cable creates a change in voltage. The change in voltage can be measured using a voltage reference in conjunction with a voltage comparator. When a voltage change is detected, the voltage comparator will know that content is being transmitted and it will send a signal to enable a charge pump.

The enabling of a charge pump may not be necessary if the content transmitter has a power source such as a wall socket. But if the content transmitter has a limited power supply, such as a cell phone, it is much more taxing on the system to provide a constant 5V signal to the content receiver. Enabling a charge pump allows a signal with a much lower voltage to be transformed into a 5V signal which is then sent to the content receiver. This method provides a 5V signal that is much less taxing on the content transmitting device.

For certain systems, specifically ones that are powered from sources other than wall sockets, e.g., batteries, the act of generating a 5V signal to be used for HDMI will consume power even if there is no sink device connected. The conversion of a one voltage to another in itself will consume power such that in systems with limited power resources this drain will reduce overall performance and operating time.

Example systems in accordance with embodiments will now be described with reference to FIGS. 1-9.

FIG. 1 illustrates an example HDMI connection 100, in accordance with an embodiment.

As illustrated in the figure, HDMI connection 100 includes a display device 102 and a charge pump 104. Display device 102 further includes a HDMI connector 106 and a mechanical insertion detector 108.

Display device 102 may be any known device that is operable to connect to another device using an HDMI cable. Non-limiting examples of a display device may be a tablet, PC, or display.

Charge pump 104 is operable to deliver a constant 5V to HDMI connector 106 via signal 116 independent of the voltage of internal VCC 110. The switching on and switching off of charge pump 104 is controlled by signal 118 sent by mechanical insertion detector 108. Charge pump 104 is additionally operable to receive a voltage from the external power source that display 102 is plugged into via internal VCC 110.

HDMI connector 106 is operable to connect display 102 to another HDMI device via an HDMI cable.

Mechanical insertion detector 108 is operable to detect the insertion of an HDMI cable into display 102. Mechanical insertion detector 108 is additionally operable to send signal 118 to charge pump 104 when an insertion has been detected.

In operation, a user will want to transfer content from a mobile device, which in this example is a cell phone, to display 102. In HDMI linked devices, a constant 5V is supplied to the receiver of content by the transmitter of content via an HDMI cable.

If the transmitter of content is a device that is plugged into a wall socket, for example a set top box (STB), it is very easy for the STB to supply a constant 5V to the content receiver. If the transmitter of content has a limited amount of power, for example a cell phone, providing a constant 5V to the receiver of content is very taxing. If the transmitter of content is only able to provide a portion of the 5V, charge pump 104 acts as a transformer and steps up the voltage while decreasing the current, because in electrical circuits power is equal to the voltage multiplied by the current.

First, a user plugs in HDMI connector 106 into display 102, the insertion is detected by insertion detector 108. Once an insertion has been made charge pump receives a voltage via internal VCC 110 from the transmitter of content, which in this example is a cell phone that is capable of delivering 2V. Generally, internal VCC 110 will be a constant voltage and this will not be required.

When the insertion of HDMI connector 106 is detected, mechanical insertion detect sends signal 118 to charge pump 104. Signal 118 enables charge pump 104 to provide a constant 5V to HDMI connector 106. Since the cell phone is only capable of delivering 2V, charge pump 104 steps up the voltage to 5V while stepping down current. Once the voltage has been stepped up, charge pump provides a constant 5V to HDMI connector 106 via signal 116.

Mechanical insertion detector 108 may be any device that is operable to switch from a first state to a second state. A non-limiting example of mechanical insertion detector 108 includes a pressure sensitive switch that is normally in the off position. In such an example, when HDMI connector 106 is inserted into display device 102 it pushes the switch down, which enables mechanical insertion detector 108 to send signal 118 to enable charge pump 104.

Once a mechanical insertion has been detected and charge pump 104 has been enabled to provide a voltage to HDMI connector 106, display device 102 sends control signal 114 to the cell phone. Control signal 114 allows display 102 and the cell phone to communicate with each other to determine display settings. Display 102 will transmit its supported display modes to the cell phone via control signal 114. One the cell phone receives the display modes supported by display 102, it can choose the optimum display settings and transmit the chosen setting back to display 102 via control signal 114. Once display 102 has received the display settings it will change its output parameters such as resolution, and color space accordingly.

Once a display setting has been chosen and settings have been adjusted the cell phone will begin transmitting content to display 102 via transition minimized differential signaling (TMDS) line 112. TMDS Lines multiplexed video and audio content transmitted on four differential pairs. The signals reach display 102 through HDMI connector 106 via TMDS line 112.

The operation of a mechanical insertion detector will now be further described with reference to FIGS. 2-3.

Figure 2:
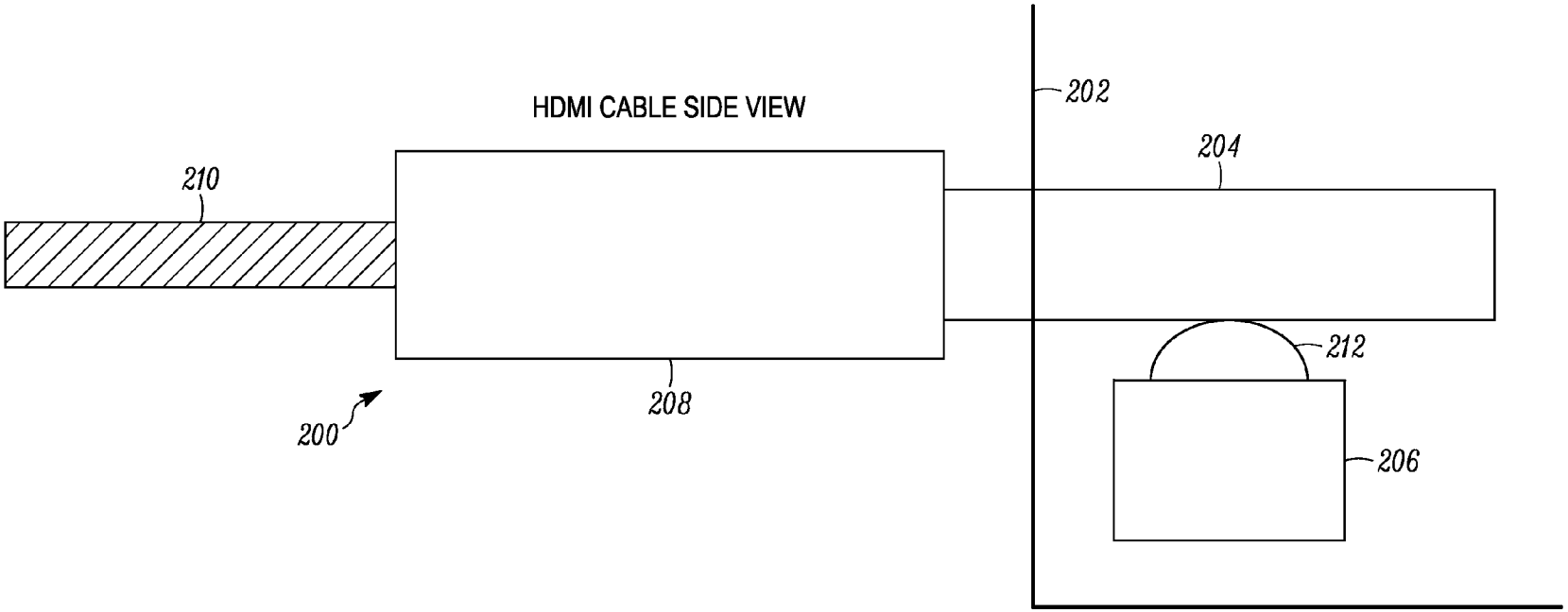
FIG. 2 illustrates a side view of a mechanical insertion detector in accordance with an aspect of an embodiment.

FIG. 2 illustrates a side view of a mechanical insertion detector system 200.

As illustrated in the figure, system 200 includes a device outer mechanicals 202, a HDMI pin portion 204, a mechanical insertion detector 206, an HDMI connector 208, an HDMI cable 210, and a switch 212.

As illustrated in the figure HDMI cable 210 is connected to HDMI connector 208. HDMI connector 208 is connected to HDMI pin portion 204. Mechanical insertion detector 206 is arranged to detect switch 212 being activated via HDMI pin portion 204.

The operation of system 200 will now be described with further reference to FIG. 3.

Figure 3:
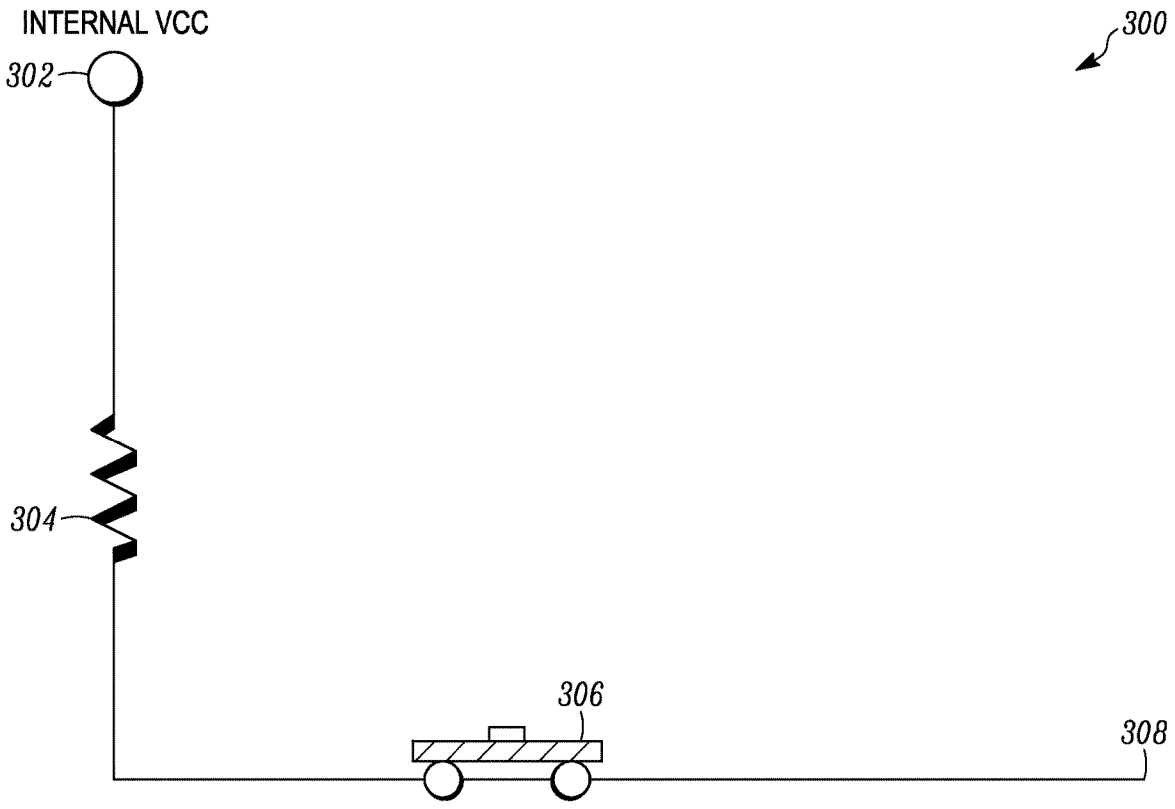
FIG. 3 illustrates a circuit diagram for the mechanical insertion detector of FIG. 2.

FIG. 3 illustrates a circuit diagram 300 of system 200 of FIG. 2.

As illustrated in the figure, circuit diagram 300 includes an internal VCC 302, a resistor 304, a switch 306, and a voltage out 308.

Internal VCC 302 is operable to deliver a constant voltage to the circuit from an external power source. Internal VCC 302 corresponds power being supplied to charge pump 104 via internal VCC 110 of FIG. 1.

Resistor 304 is the resistance of the circuit of circuit diagram 300.

Switch 306 is operable to be open in a one state and closed in a second state. In a first state switch 306 is open and does not allow a constant voltage to flow from charge pump 104 of FIG. 1. In a second state switch 306 is closed and allows a constant voltage to flow from charge pump 104 to HDMI connector 106 of FIG. 1. The switching of switch 306 from a first state to a second state corresponds to mechanical insertion detector 108 of FIG. 1 and mechanical insertion detect 206 of FIG. 2 enabling charge pump 104 via signal 118 of FIG. 1.

Voltage out 308 corresponds to charge pump 104 sending a constant voltage to HDMI connector 106 via signal 116 of FIG. 1.

In operation, a user will connect HDMI cable 210 to device outer mechanicals 202 via HDMI connector 208. When HDMI connector 208 is inserted to device outer mechanicals 202, HDMI pin portion 204 applies pressure to switch 212. The pressure applied to switch 212 forces it down, and the downward pressure of switch 212 is detected by mechanical insertion detector 206.

The detection of an insertion by mechanical insertion detect 206 corresponds to switch 306 switching from an open first state, to a closed second state. Switch 306 switching from a first state to a second state corresponds to mechanical insertion detect 108 enabling charge pump 104 of FIG. 1.

Power flowing from internal VCC 306 through resistance 304 and past switch 306 via signal 308 corresponds to internal VCC 110 flowing through charge pump 104 to HDMI connector 102 via signal 116 of FIG. 1.

Figure 4:
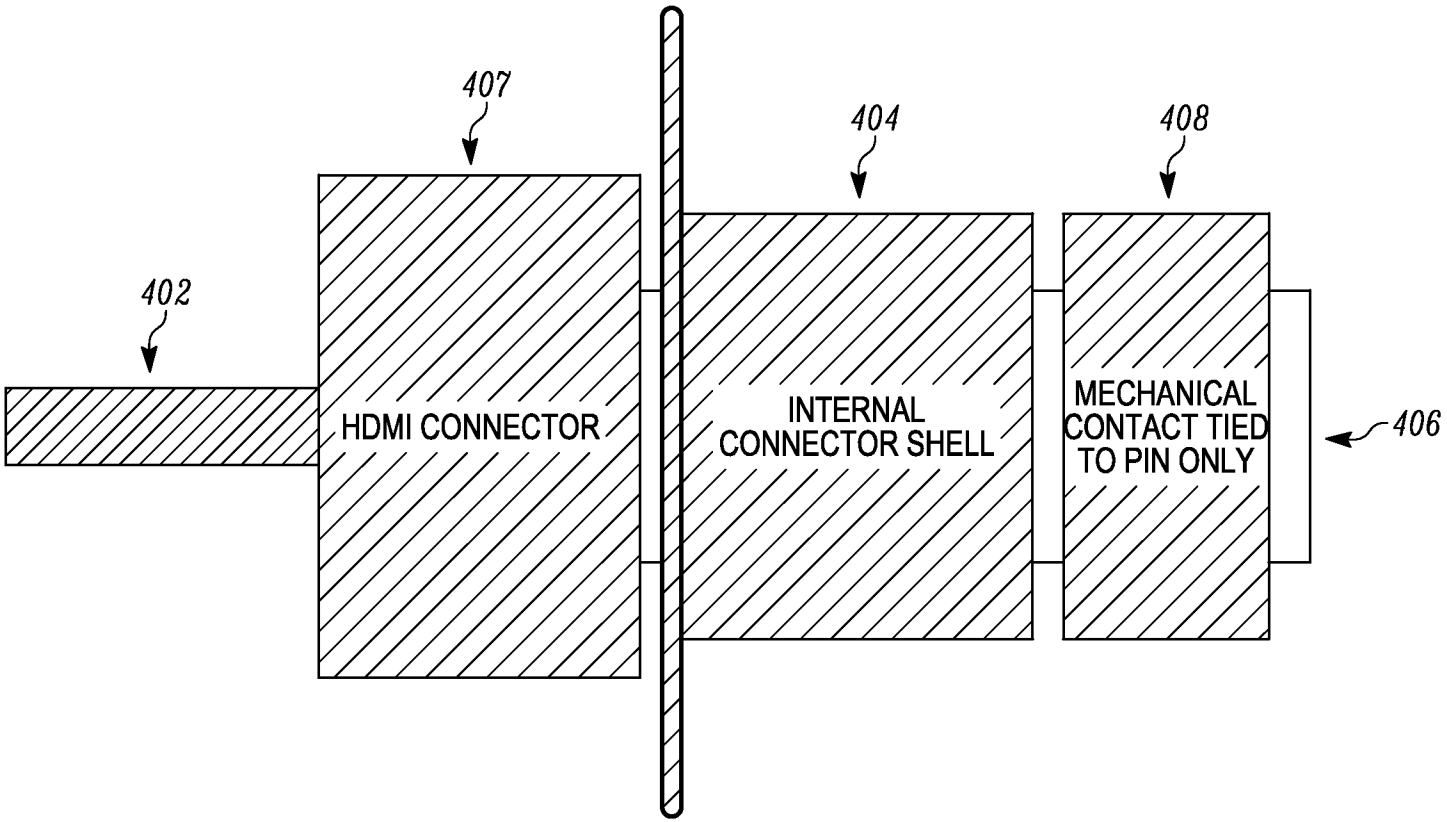
FIG. 4 illustrates a vertical view of an electrical insertion detector in accordance with an aspect of an embodiment.

FIG. 4 illustrates a vertical view of an electrical HDMI insertion detector 400, in accordance with an embodiment.

As illustrated in the figure, electrical HDMI insertion detector 400 includes an HDMI cable 402, an HDMI connector 404, and an HDMI pin portion 406.

Figure 5:
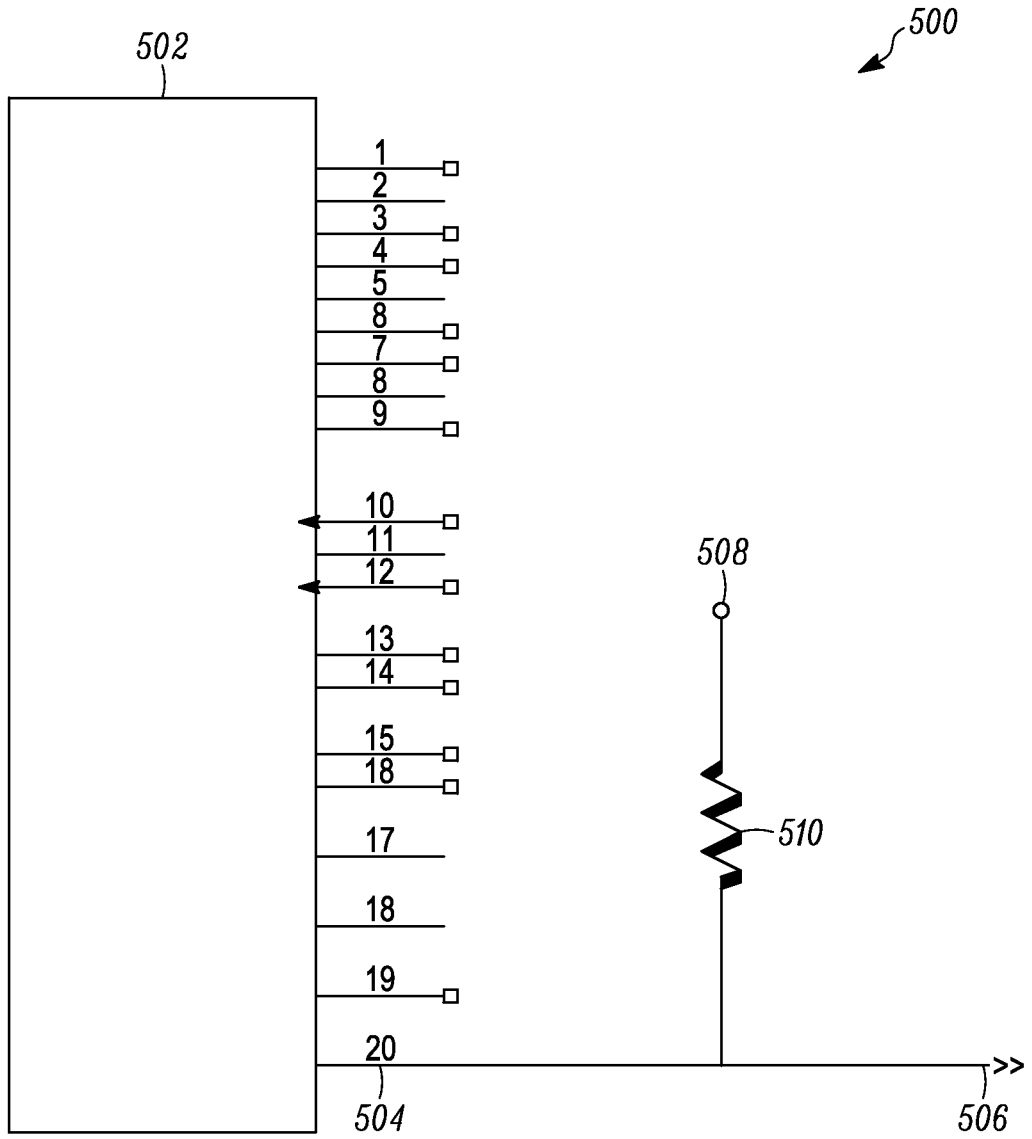
FIG. 5 illustrates a circuit diagram for electrical insertion detector of FIG. 4.

The operation of electrical HDMI insertion detector 400 will now be further described with additional reference to FIG. 5.

FIG. 5 illustrates a circuit diagram 500 of HDMI pin portion 406.

As illustrated in the figure, circuit diagram 500 includes a pin out portion 502, a connection detect pin 504, an internal VCC 508, a resistor 510 and a voltage out 506.

In operation a user will want to transmit content from a one device to another via an HDMI cable. First the user will insert the HDMI cable connector 404 into a device. In this example, HDMI cable connector 404 represents the internal mechanical connections, whereas HDMI pin portion 406 (and the shell) do not. Once inserted, HDMI pin portion 406 will be connected via pin outs of the device that it is plugged into. Once connected, a connection is able to be detected by connect detect 504 of pin out portion 502. Once connect detect 504 has detected a connection a charge pump is enabled via signal 506. Pin out portion 502 corresponds to pin out portion 408 of FIG. 4.

Figure 6:
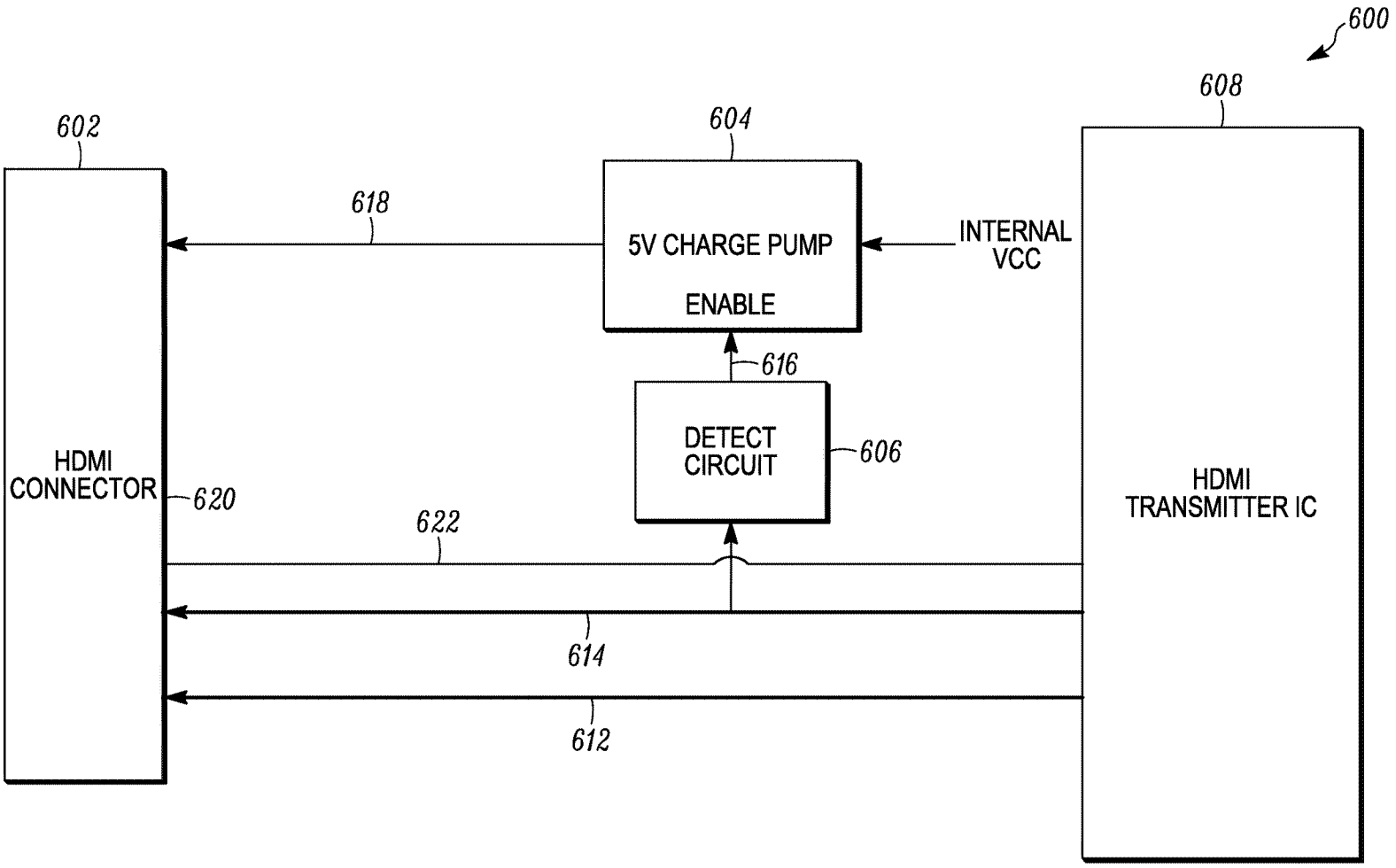
FIG. 6 illustrates an example implementation of an electrical insertion detector system in accordance with an aspect of an embodiment.

FIG. 6 illustrates system 600 in which the detection of an HDMI connector insertion is detected via an electrical circuit.

As illustrated in the figure, system 600 includes an HDMI connector 602, a charge pump 604, a detect circuit 606, an HDMI sink 608, and hotplug 620.

HDMI sink 608 is arranged to transmit TMDS channel 614 and control channel 612 to HDMI connector 602. Detect circuit 606 is arranged to detect a voltage from TMDS channel 614. Detect circuit 606 is additionally arranged to send enable signal 616 to charge pump 604. Charge pump 604 is arranged to receive internal VCC 610 and output power to HDMI connector 602 via signal 618. Hotplug 620 is arranged to receive power from HDMI sink 608 via signal 622. Hotplug 620 is an input to the transmitter IC. The VCC provided into the transmitter device will result in Hotplug being asserted.

Detect circuit 606 is operable to detect a change in voltage or current in TMDS channel 614. In a non-limiting example, detect circuit 606 is a voltage comparator.

Hotplug 620 is operable to receive power from HDMI sink 608 via signal 618.

The operation of system 600 will now be described with additional reference to FIG. 7.

Figure 7:
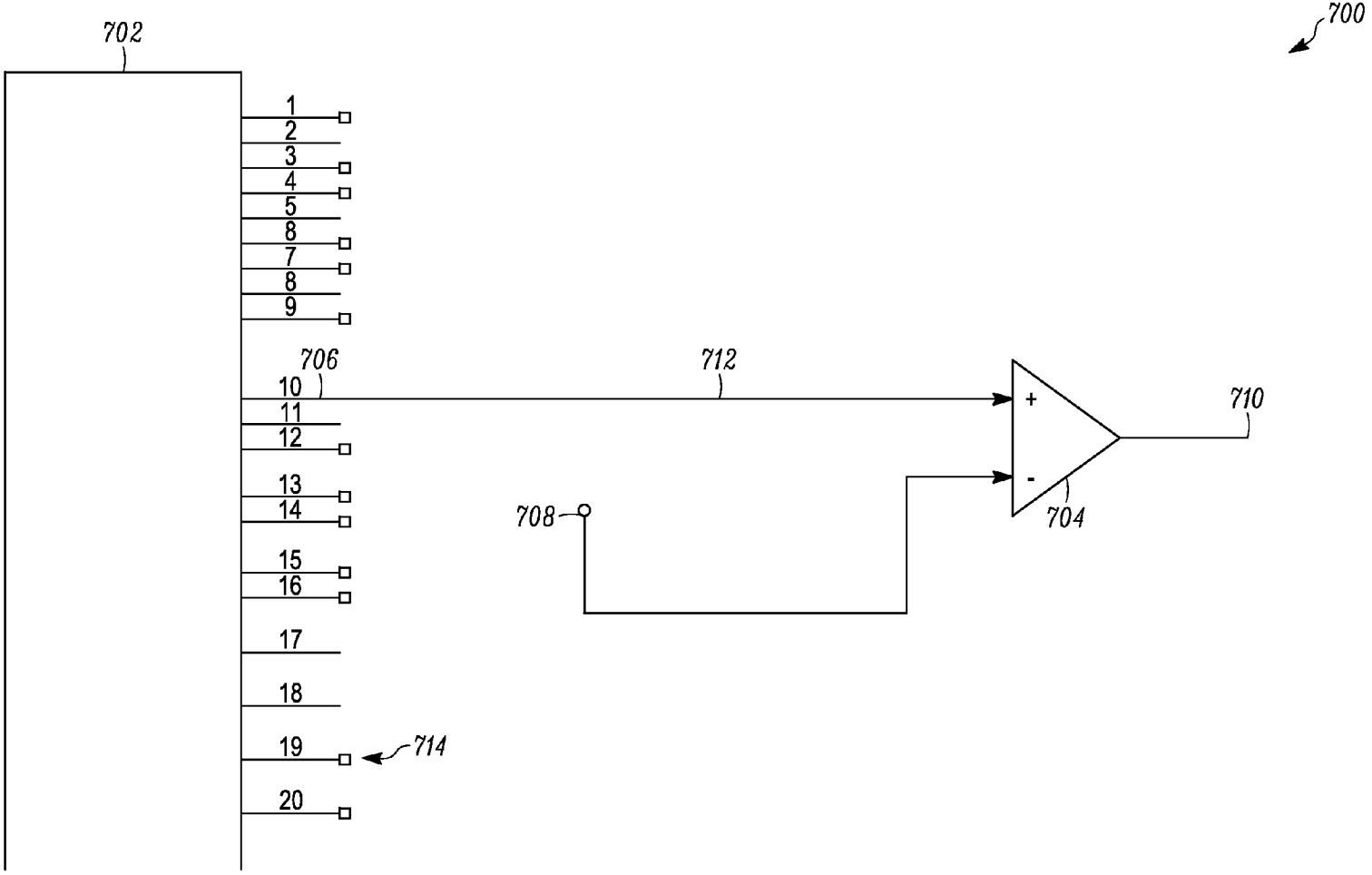
FIG. 7 illustrates a circuit diagram for the electrical insertion detector system of FIG. 6.

FIG. 7 illustrates a circuit diagram 700 of system 600.

As illustrated in the figure, circuit diagram 700 includes an HDMI connector 702, a voltage comparator 704, TMDS line connection 706, and voltage reference 708.

HDMI connector 702 is arranged to transmit TMDS signal 712 via TMDS line connection 706. Voltage comparator 704 is arranged to receive TMDS signal 712 and signal 714 from voltage reference 708. Voltage comparator 708 is additionally arranged to output compared voltage signal 710.

Voltage reference 708 is operable to provide a constant voltage to voltage comparator 704. In this example, the voltage level of voltage reference 704 is equal the voltage of the power being provided by the content source device. A non-limiting example of voltage reference 704 may be a diode, tube, or battery.

Voltage comparator 704 is operable to compare the voltage difference between voltage reference 708 and TMDS signal 712. Voltage comparator is additionally operable to send enable signal 710.

In one example mode of operation, a small voltage is applied to TMDS lines 614 and 712 at all times. Since there is no load or current being drawn, there will be minimal power consumption in this mode. When a connection is made and a load is applied to TMDS lines 614 and 712, the resulting voltage on TMDS lines 614 and 712 will be reduced versus the open circuit voltage. Comparator 704 and reference voltage 708 are designed such that the change in voltage on TMDS line 712 will result in the switching of comparator output 710. Charge pump 604 will be enabled by comparator output 710, resulting in 5V to be applied to VCC output 608. The receiver, upon receiving power on VCC input 608, will then set hotplug 714 to a high state, indicating a normal HDMI connection. Source device 608 will then query the capabilities of the sink device via the control channel or DDC lines 612 and configure the output video accordingly. This example uses TMDS lines 712. However, it should be noted that other techniques may be used on the DDC or other control lines in the interface.

Figure 8:
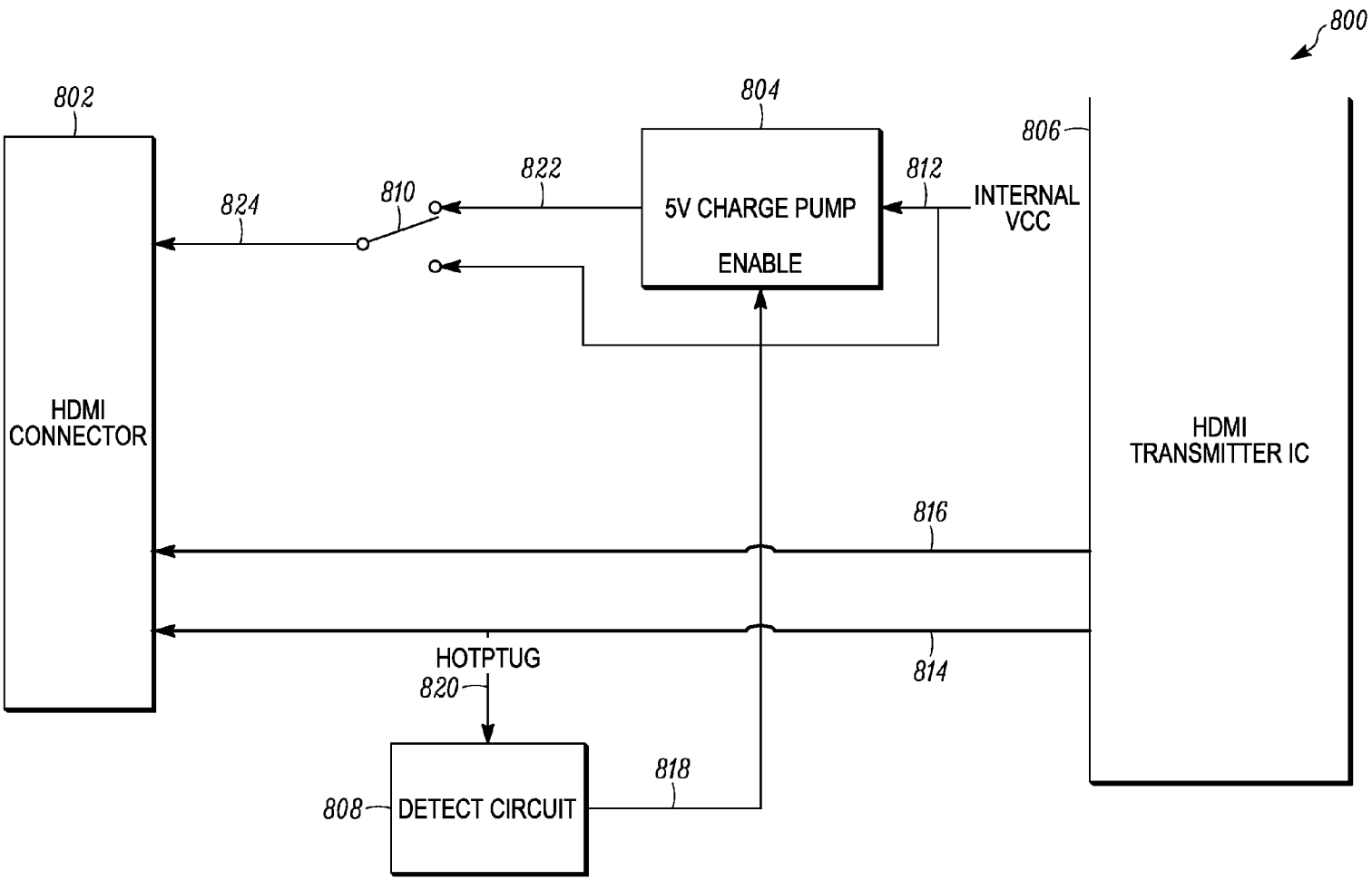
FIG. 8 illustrates another implementation of an electrical insertion detector system in accordance with an aspect of an embodiment.

FIG. 8 illustrates an example system 800 in which an electrical insertion detector is used.

As illustrated in the figure, system 800 includes an HDMI connector 802, a charge pump 804, an HDMI sink 806, a detect circuit 808, and a switch 810.

HDMI sink 808 is arranged to transmit TMDS channel 816 and control channel 814 to HDMI connector 802. Detect circuit 808 is arranged to detect a voltage from hotplug 820. Detect circuit 808 is additionally arranged to send enable signal 818 to charge pump 804. Charge pump 804 is arranged to receive internal VCC 812 and output power to HDMI connector 802 via signal 818. Switch 810 is arranged to deliver power from internal VCC 810 to HDMI connector 802 in a first state and to deliver power from charge pump 804 to HDMI connector 802 in a second state.

Figure 9:
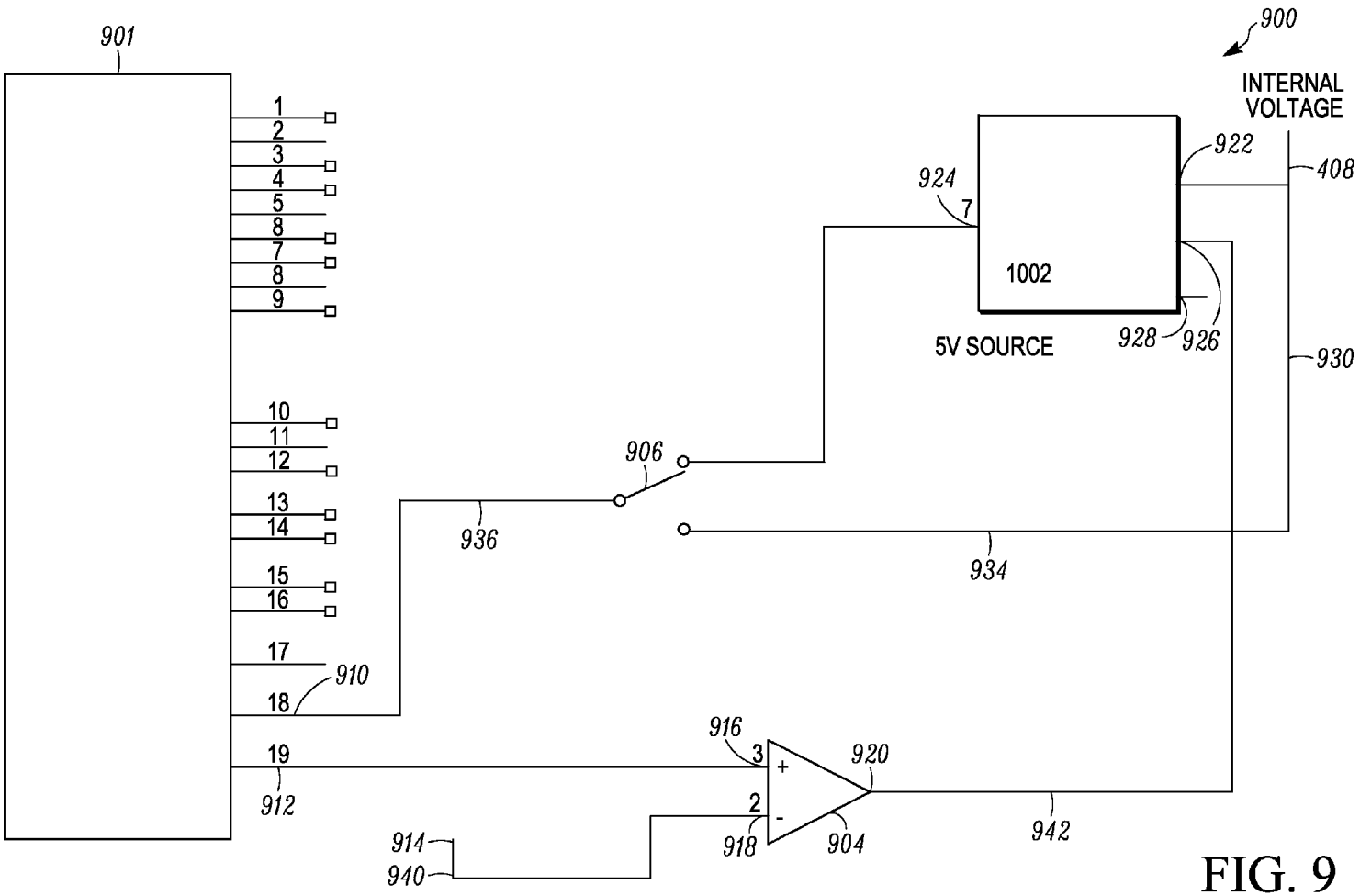
FIG. 9 illustrates a circuit diagram for the electrical insertion detector system of FIG. 8.

The operation of system 800 will now be further described with additional reference to FIG. 9.

FIG. 9 illustrates a circuit diagram 900 for system 800 of FIG. 8.

As illustrated in the figure, circuit diagram 900 includes an HDMI pin out portion 901, a charge pump 1002, a voltage comparator 904, a switch 906, an internal VCC 908, a 5V power connection 910, a hotplug connection 912, and a voltage reference 914.

As illustrated in the figure, voltage comparator 904 is arranged to receive signals from voltage reference 914, and hotplug connection 912. Voltage comparator 904 is additionally arranged to output an enable signal to charge pump 902. Switch 906 is arranged to deliver power to 5V power connection 910 from internal VCC 908 in a first state and from charge pump 902 in a second state.

In operation, a user will want to transmit content from HDMI sink 806 to another device via HDMI connector 802. Once the user has inserted HDMI connector 802, HDMI sink 806 will initially provide power via 5V power 901 with switch 906 in the first state such that internal voltage 934 is being passed to the 5V power 901 pin. The power applied will be less than the required 5V for proper HDMI operation. Hotplug 820 will pass the lower voltage applied to 5V power 901 through the sink device via connector 802. Comparator 904 will detect that the passed through voltage on hotplug 820 is higher that reference voltage 940. Comparator output 942 will then drive charge pump enable 926 to generate and apply 5V to charge pump output 924. At this point switch 902 shall be set into the second state such that output 936 is connected to charge pump output 924. At this point the 5V power output 910 will be in the proper full voltage state. Hotplug 820 will then go to the proper asserted state and the normal HDMI connection process will commence, Once power has been provided to the receiver of content, the two devices may use control channel 814 to communicate about display settings. The receiver of content will transmit its supported display modes to HDMI sink 806 via control channel 814. Once HDMI sink 806 receives the display modes that are supported by the receiver of content, it can choose the optimum display setting and transmit the selected setting back to the receiver of content. After the receiver of content receives the selected display setting, it can adjust display parameters such as resolution, brightness, and contrast.

Before insertion the difference in voltages of the signals being supplied to voltage comparator 904 was 3V. Once power was supplied via hotplug 820 voltage comparator 904 finds that there is only a 2V difference in the signals. This change in voltage differences indicates that a device has been connected and voltage comparator 904 enables charge pump 902 via signal 942. The comparing of voltages by voltage comparator 904 and enabling of charge pump 902 corresponds to detect circuit 808 detecting an insertion and enabling charge pump 804 of FIG. 8.

Before charge pump 902 is enabled, switch 906 is in a first state which enables internal VCC 908 to provide a constant 3V to the receiver of content through 5V power connection 910 via signal 930 and signal 936. When charge pump 902 is enabled, switch 906 switches from state one to state two, which allows internal VCC 908 to provide a voltage to charge pump 902 via connection 922. At this point internal VCC 908 can deliver its normal voltage to charge pump 902. Depending on the normal voltage of internal VCC 908, charge pump 902, may step up or step down the voltage to 5V. After transforming internal VCC 908, charge pump 902 may deliver a constant 5V to 5V power connection 910 via signal 932 and signal 936. The switching of switch 906 from a first state to a second state corresponds to switch 810 switching from a first state to a second state in FIG. 8.

Once charge pump 804 has been enabled and is providing a constant 5V to the receiver of content on the other end of HDMI connector 802, HDMI sink 806 may transmit content via TMDS signal 816.

In one embodiment, a mechanical insertion detector may be used to detect the connection of two devices via an HDMI cable. The insertion may be detected when the HDMI connector depresses a pressure sensitive switch. The depression of the switch then instructs the mechanical insertion detector to enable a charge pump.

In another embodiment, an electrical insertion detector may be used to detect the connection of two devices via an HDMI cable. The insertion may be detected when a change in voltage is measured by a voltage comparator. The change in voltage signals that an HDMI insertion has been made and that a charge pump should be enabled.

The enabling of a charge pump may not be necessary if the content transmitter has a power source such as a wall socket. But if the content transmitter has a limited power supply, such as a cell phone, it is much more taxing on the system to provide a constant 5V signal to the content receiver. Enabling the 5V signal only when required removes the burden of creating 5V until needed for active HDMI transmission. This method provides a 5V signal that is much less taxing on the content transmitting device.

The foregoing description of various preferred embodiments have been presented for purposes of illustration and description. It is not intended to be exhaustive or to limit embodiments to the precise forms disclosed, and obviously many modifications and variations are possible in light of the above teaching. The example embodiments, as described above, were chosen and described in order to best explain the principles of embodiments and their practical application to thereby enable others skilled in the art to best utilize embodiments and with various modifications as are suited to the particular use contemplated. It is intended that the scope of embodiments be defined by the claims appended hereto.

We claim:

1. A battery-powered mobile device comprising an audiovisual source, the battery-powered mobile device for use with an audiovisual sink device and with a cable having a first end and a second end, wherein:

the audiovisual sink device is configured to receive digital television audiovisual signals, and the cable includes a data channel, a control channel and a power line; the cable being configured to transmit the digital television audiovisual signals, the first end being configured to connect to the audiovisual sink device for transmitting the digital television audiovisual signals from the cable to the audiovisual sink device, and the second end being configured to connect to the battery-powered mobile device for receiving the digital television audiovisual signals from the battery-powered mobile device;

the battery-powered mobile device comprising:

a connector configured to receive the second end of the cable and configured to connect to the cable, wherein the connector is configured, when connected to the cable, to transmit the digital television audiovisual signals from the battery-powered mobile device via the cable to the audiovisual sink device;

a detecting portion configured to generate a connection signal based on detection of a connection of the connector to the cable, wherein the detecting portion is configured to detect a change in voltage or current in a transition minimized differential signaling (TMDS) line communicatively coupled to the connector; and a power source in the battery-powered mobile device, the power source configured to provide power from a battery, wherein the power source steps up a voltage of the power from the battery to a constant voltage of 5V and steps down a respective current of the power from the battery, the power being provided through the cable from the battery-powered mobile device to the audiovisual sink device based on the connection signal indicating connection of the connector to the cable.

2. The battery-powered mobile device of claim 1, wherein the power source comprises a 5V charge pump.

3. The battery-powered mobile device of claim 1, wherein the detecting portion comprises a comparator and a reference voltage supply mechanical switch.

4. The battery-powered mobile device of claim 1, wherein the detecting portion comprises a comparator and a reference voltage supply.

5. The battery-powered mobile device of claim 4, wherein the detecting portion further comprises:

a mechanical switch for generating the connection signal based on the connection of the connector.

6. The battery-powered mobile device of claim 5, wherein the connection signal comprises an enable signal configured to enable the power source to provide power.

7. The battery-powered mobile device of claim 4, wherein the connector is configured to provide a signal when connected to the cable, wherein the comparator is arranged to compare a voltage from the reference voltage supply with the signal, and wherein the comparator is configured to output the connection signal based on the comparison.

8. The battery-powered mobile device of claim 7, wherein the connection signal comprises an enable signal configured to enable the power source to provide power.

9. A method of using an audiovisual sink device and a cable having a first end and a second end, the audiovisual sink device being configured to receive digital television audiovisual signals from a battery-powered mobile device comprising an audiovisual source, the cable including a data channel, a control channel and a power line and being configured to transmit the digital television audiovisual signals, the first end being configured to connect to the audiovisual sink device for transmitting the digital television audiovisual signals from the second end to the audiovisual sink device, the second end being configured to connect to the battery-powered mobile device for receiving the digital television audiovisual signals from the battery-powered mobile device, the method comprising:

connecting the cable to a connector of the battery-powered mobile device configured to receive the second end, wherein the cable is configured, when connected to the connector, to transmit the digital television audiovisual signals from the battery-powered mobile device via the cable to the first end;

generating, by a detecting portion that is configured to detect a change in voltage or current in a transition minimized differential signaling (TMDS) line communicatively coupled to the connector, a connection signal based on the connection of the connector to the cable; and providing power from a battery, via a power source in the battery-powered mobile device, wherein the power source steps up a voltage of the power from the battery to a constant voltage of 5V and steps down a respective current of the power from the battery, the power being provided through the cable from the battery-powered mobile device to the audiovisual sink device based on the connection signal indicating the connection of the connector to the cable.

10. The method of claim 9, wherein the providing, via the power source, power based on the connection signal comprises providing, via a 5V charge pump, power based on the connection signal.

11. The method of claim 10, wherein the detecting portion comprises a mechanical switch for generating the connection signal based on the connection of the connector to the cable.

12. The method of claim 10, wherein the detecting portion comprises a comparator and a reference voltage supply for generating the connection signal based on the connection of the connector to the cable, the generating further comprising:

providing, via the connector, a signal when the connector is connected to the cable;

comparing, via the comparator, a voltage from the reference voltage supply with the signal; and outputting, via the comparator, the connection signal based on the comparison.

13. The method of claim 12, wherein the connection signal comprises an enable signal configured to cause the battery-powered mobile device to enable the power source to provide power.

* * * * *